US006276163B1

(12) United States Patent
Broadbent

(10) Patent No.: US 6,276,163 B1
(45) Date of Patent: Aug. 21, 2001

(54) BEVERAGE CONTAINER WITH ICE COMPARTMENT

(76) Inventor: John Allen Broadbent, 5558 S. Yampa St., Aurora, CO (US) 80015

( * ) Notice: Subject to any disclaimer, the term of this patent is extended or adjusted under 35 U.S.C. 154(b) by 0 days.

(21) Appl. No.: 09/626,216

(22) Filed: Jul. 26, 2000

(51) Int. Cl.[7] ..... F25D 3/08

(52) U.S. Cl. ..... 62/457.4; 62/457.3; 62/371; 62/530

(58) Field of Search ..... 62/371, 372, 457.3, 62/457.4, 457.5, 530

(56) References Cited

U.S. PATENT DOCUMENTS 6,112,537 * 9/2000 Broadbent ..... 62/293
6,173,581 * 1/2001 Wyatt ..... 62/457.3
6,209,344 * 4/2001 Mahajan ..... 62/457.3

FOREIGN PATENT DOCUMENTS 3-187844 * 8/1991 (JP) ..... 62/457.3

* cited by examiner

*Primary Examiner*—William Doerrler
*Assistant Examiner*—Melvin Jones
(74) *Attorney, Agent, or Firm*—Gibson, Dunn & Crutcher LLP

(57) ABSTRACT

A beverage container having a beverage compartment and an ice compartment. Prior to beverage consumption, the container is placed in a dual-temperature environment that freezes the beverage in the ice compartment but doesn't freeze the beverage in the beverage compartment. A barrier inside the beverage container minimize the mixing of the beverage in one compartment with the beverage in the other compartment, allowing the beverage in the ice compartment to freeze while the beverage in the beverage compartment does not. Once removed from refrigeration, the frozen beverage in the ice compartment keeps the beverage in the beverage compartment cool for an extended period of time.

20 Claims, 8 Drawing Sheets

BEVERAGE CONTAINER WITH ICE COMPARTMENT

FIELD OF THE INVENTION

The present invention relates to the field of beverage containers. Specifically, the present invention relates to beverage containers having a beverage compartment and an ice compartment separated by a barrier which allows the beverage in the ice compartment to freeze while the beverage in the beverage compartment does not.

BACKGROUND OF THE INVENTION AND PRIOR ART

It is common practice for consumer beverages to be packaged in plastic bottles and sold cold, from some type of refrigerated storage. These beverages are usually purchased for immediate consumption, since they cannot stay cold very long without refrigeration. With the larger sized bottles (20 fluid ounces or more), the beverage usually warms up substantially before it is finished, even if consumed immediately.

If a person wants to have a beverage that will stay cold for several hours, he or she has only a few options. The beverage could be bought and then put in a refrigerator, thermos or ice chest, the beverage could be poured into a glass with ice, or the beverage could be frozen in the person's freezer overnight to freeze the contents. However, freezing a bottle at home requires prior planning and effort and the taste of drinks (other than water) can be affected by freezing.

Other than dispensing a beverage into an ice-filled cup, there are no commercially available beverages (e.g., soft drinks, sports drinks, water, etc.) sold in containers that will keep a beverage cold for any significant length of time. Even an ice-filled cup will warm up after a couple of hour and become undesirably diluted in the process.

U.S. Pat. No. 5,284,028 issued to Wilco R. Stuhmer describes a beverage container having a main beverage chamber and an ice chamber consisting of a polymeric film pouch located within the main chamber. By filling the ice chamber with ice, a beverage in the beverage chamber can be kept cold by virtue of the heat transfer from the beverage to the ice through the polymeric film. This configuration prevents dilution of the beverage from the melting ice. However, this invention requires that the container be filled with both the ice and the beverage just prior to consumption. There is no way to pre-package the beverage and the ice combination and store it without having either the ice melt or the beverage freeze.

U.S. Pat. No. 5,487,486 issued to David M. Meneo describes a beverage container having an ice compartment below, and in heat exchange contact with, an upper beverage compartment. By scooping ice into the ice compartment (which opens downward) and closing the ice compartment with a watertight lid, the beverage in the beverage compartment can be kept cold by contact with the cold ice compartment. This invention is intended for use as a pitcher, not as a retail beverage container. And again, the container must be filled with ice and beverage just prior to use—there is no way to use this invention for pre-packaged beverages.

A number of patents have been issued relating to self-cooling beverage cans containing a refrigerant cooling system. For example, U.S. Pat. No. 4,669,273 to Fischer et al., U.S. Pat. No. 4,791,789 to Wilson, U.S. Pat. No. 5,447,039 to Allison, and U.S. Pat. No. 5,692,391 to Joslin all discuss beverage cans with a refrigerant-vaporization-based cooling systems (i.e., the cans all contain refrigerant which, when released, vaporizes thereby cooling the can). However no refrigerant-containing can has yet proven to be commercially viable.

Thus none of the prior art has provided a commercially viable means for selling pre-packaged beverages in self-cooling containers.

A primary objective of this invention is to provide a beverage container for selling pre-packaged beverages that has a built-in ice cube, allowing the beverage to remain cold for many hours after it has been removed from refrigeration.

Another primary objective of this invention is to provide a beverage container containing ice and having a slow-melting feature that will, if the container is inverted, retain sufficient ice inside to cool the beverage for five or more hours after the un-insulated container has been removed from refrigeration.

Another primary objective of this invention is to provide a container having a beverage compartment and an ice compartment that can be kept in a dual-temperature-refrigerating device that will keep the ice frozen while simultaneously keeping the beverage unfrozen. Such dual-temperature refrigerating devices could include refrigerated display cases, freezers, devices housed within freezers, vending machines, domestic refrigerator-freezers or other refrigerated display apparatus.

Another primary objective of this invention is to provide a self-cooling beverage container that is cost-effective to manufacture.

Another primary objective of this invention is to provide a self-cooling beverage container can be cost-effectively bottled (i.e., filled and capped).

Another primary objective of this invention is to provide a self-cooling beverage container that after bottling can be cost-effectively shipped, stored and/or displayed for retail sale.

Another primary objective of this invention is to provide a self-cooling beverage container utilizing ice as a source of cooling yet one that can be stored warm for any length of time.

Another primary objective of this invention is to provide a self-cooling beverage container that is suitable for use with carbonated beverages.

Another primary objective of this invention is to provide a self-cooling beverage container containing no materials or chemicals that would affect the taste of the beverage or the ability of the container to be recycled.

SUMMARY OF THE INVENTION

As used herein, the term "beverage" shall not be limited to liquids for drinking, but shall include any fluid, including water. Likewise the term "ice" is used for convenience herein to refer to frozen water and/or frozen beverages other than water, and the temperature "32° F." is used to refer to the liquid-solid phase change temperature for both water and/or other beverages.

The present invention is a beverage container in which a portion of the beverage inside can be frozen in order to keep the remaining liquid beverage cold for an extended period of time. The beverage container has two compartments: a beverage compartment and an ice compartment. The two compartments are separated by a barrier located within the beverage container. Both compartments are filled with the same beverage, but the beverage in the ice compartment will be frozen, while the beverage in the beverage compartment will be maintained in its liquid state. Because only a small portion (one-third to one-fifth) of the beverage will be frozen, there is minimal change in the taste of the beverage due to freezing.

By placing the container in a dual-temperature environment that exposes the ice compartment to sub-freezing temperatures (i.e., below 32 °F.) and the beverage compartment to above-freezing temperatures, the beverage in the ice compartment will be caused to freeze while the beverage in the beverage compartment will not. Once removed from refrigeration, the beverage in the beverage compartment will be cooled by the frozen beverage in the ice compartment.

It is the barrier within the beverage container that allows this freezing to happen properly. The barrier is designed so that the beverage can pass around or through it from one compartment to the other when the container is being filled or emptied. When the container is full and stationary, however, the presence of the barrier greatly reduces the beverages in the two compartments from mixing with each other when those compartments are held at different temperatures. It is this reduction in mixing that allows the beverage in the ice compartment to be readily frozen while the beverage in the beverage compartment is not. Normally, without such a barrier, it is difficult to freeze only a portion a beverage in a single-compartment container. This is because thermal convection currents tend to keep all of the beverage in the container at a fairly uniform temperature, and thus causes the beverage to either all freeze, or all stay unfrozen. However, with the barrier in place, it is possible for the beverage in the ice compartment to get cold enough to freeze, while the beverage in the beverage compartment does not. It is not required that the barrier be thermally insulating to any significant degree—simply the reduction in mixing is sufficient to allow the desired freezing.

The barrier also allows the container to keep the beverage cold once it is removed from refrigeration. Because the barrier is thin, it allows heat transfer between the frozen beverage and the liquid beverage sufficient to cool the liquid when the container is initially removed from the dual-temperature environment described above. Once the frozen beverage in the ice compartment has melted some, tipping the container causes the cold liquid beverage in the ice compartment to pass into the beverage compartment, thereby keeping the beverage cold.

In the preferred embodiment of the present invention, the barrier is part of a larger, specially punched and formed plastic sheet which is rolled-up and inserted into the beverage container. This plastic sheet is very low in cost and can be used with existing, off-the-shelf containers; both bottles and cans. It can be used with virtually any beverage, including carbonated beverages and so-called "sports drinks".

The preferred embodiment of the present invention is configured to also provide a "slow-melting" feature that, when the container is inverted, allows the ice to melt at a much slower rate than it would normally. This slow-melting configuration allows retention of sufficient ice, even after five hours without refrigeration, to cool the beverage to a desirably cold temperature.

It is anticipated that beverage containers utilizing the present invention will typically not be frozen until they have been delivered to their intended point-of-sale, for example within a vending machine or in a refrigerator or freezer at a convenience store. Prior to reaching the point-of-sale, they can be transported warm and/or stored warm for any length of time. Thus, no special or expensive refrigerated transport or storage equipment is required. Likewise, if a container becomes unfrozen after having been frozen (due to a power failure, for example) it can either be re-frozen or sold as-is. Thus, unlike ice cream or other frozen foods, there is minimal "spoilage" potential due to loss of refrigeration.

Special equipment is required to provide the dual-temperature environment described above. In its simplest form, the equipment consists of an insulated, internally heated box that is placed inside a freezer. This box surrounds the beverage compartment of the container, keeping that part of the container warm (above freezing). The ice compartment of the container, however, protrudes outside the box and into the freezer. Thus the beverage compartment sees above-freezing temperatures while the ice compartment sees the sub-freezing temperatures in the freezer.

A variety of other, more elaborate equipment types are also anticipated for providing the needed dual-temperature environment. The other equipment types include walk-in and reach-in refrigerators and freezers, refrigerated display cases, vending machines, and domestic refrigerator-freezers, etc. The common element in these new equipment types is that they would all be configured to provide a subfreezing temperature environment for the ice compartments of the containers while providing an above-freezing temperature environment for the beverage compartments.

How the present invention is accomplished will become apparent from the following detailed description, discussion and the appended claims, taken in conjunction with the drawings.

BRIEF DESCRIPTION OF THE DRAWINGS

A better understanding of the invention can be had by reference to the following Detailed Description in conjunction with the accompanying Drawings, wherein:

FIG. 2 illustrates the barrier, the beverage compartment and the ice compartment.

Figure 1:
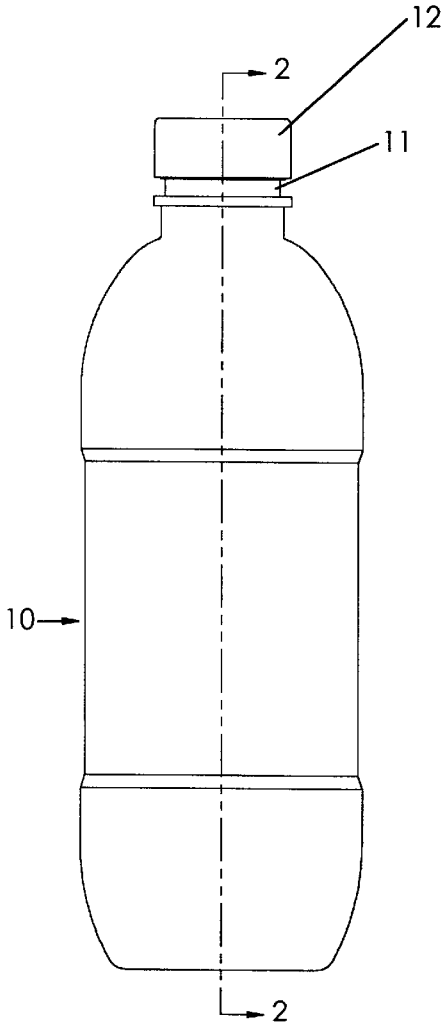
FIG. 1 is a front view of a beverage container.

| Reference Numerals in Drawings | |
|---|---|
| Beverage container | 10 |
| Mouth | 11 |
| Cap | 12 |
| Barrier | 14 |
| Beverage compartment | 16 |
| Ice compartment | 18 |
| Beverage | 20 |
| Barrier insert | 22 |
| Barrier insert (flat) | 22A |
| Barrier insert (bent) | 22B |
| Barrier insert (rolled-up) | 22C |
| Tube (simplified) | 24 |
| Living hinge | 26 |
| Cuts | 28 |
| Rectangular flaps | 30 |
| Triangular flaps | 32 |
| Holes | 34 |
| Air | 36 |
| Freezing enclosure | 38 |
| Below-freezing environment | 40 |
| Above-freezing environment | 42 |
| Frozen beverage or ice | 50 |
| Air | 52 |
| Contours | 54 |
| Contour, upper face | 55 |
| Contour, lower face | 56 |
| Walls | 60 |
| Cavities | 62 |
| Porous object | 70 |
| Insulated sleeve | 80 |
| Insulated cup-holder adapter | 82 |
| Adapter, upper portion | 84 |
| Adapter, lower portion | 86 |

DETAILED DESCRIPTION

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Construction

Referring to FIG. 1, a front view of a conventional beverage container 10 is shown. In the preferred embodiment, the beverage container 10 is a molded plastic beverage container made of a clear plastic resin such as PETE (Polyethylene Terephthalate) or other material suitable for use with beverages. Container 10 has a mouth 11 and a cap 12. If container 10 is intended to hold a carbonated beverage, it will have a design and a wall thickness suitable for containing the pressures associated with such beverages. If container 10 is intended to hold a drink that requires "hot-filling", i.e., the container is filled while the beverage is hot, the container 10 may have additional contours in its walls to prevent distortion due to the "hot-filling" process. Container 10 could also be a beverage can (an aluminum can, for example), in which case the mouth 11 and cap 12 would instead be the standard opening and closure means found on such cans.

Figure 2:
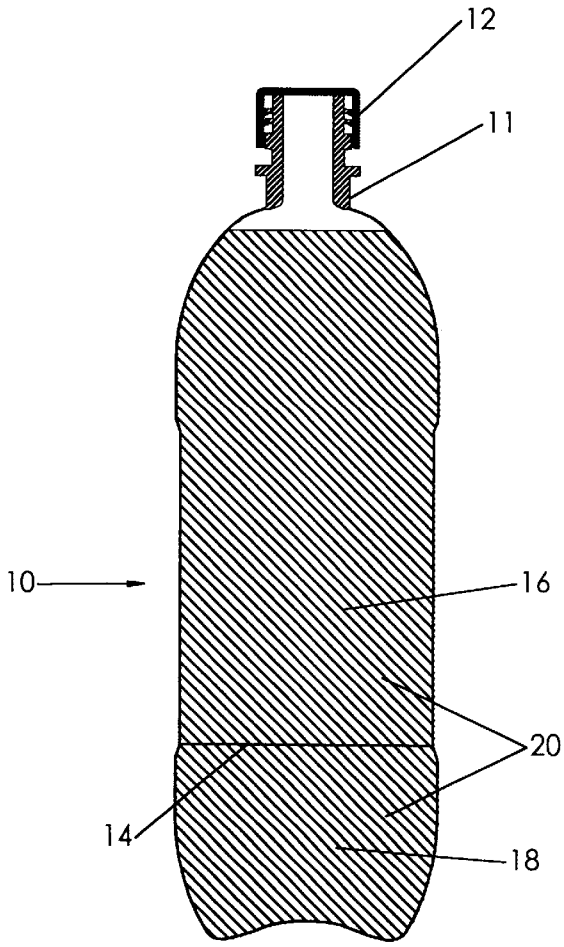
FIG. 2 is a vertical cross-section of the beverage container taken along line 2—2 of FIG. 1.

FIG. 2 shows a vertical cross-section of container 10 taken along line 2—2 of FIG. 1. FIG. 2 illustrates a barrier 14 and two compartments: a beverage compartment 16 and an ice compartment 18 within container 10. The container 10 and both compartments are filled with a beverage 20. Barrier 14 delineates the bottom of beverage compartment 16 and the top of ice compartment 18. While it would be possible to have the two compartments arranged in other configurations, the preferred embodiment is to have beverage compartment 16 located between ice compartment 18 and mouth 11. This arrangement prevents frozen beverage in the ice compartment 18 from obstructing the mouth 11 of the container 10.

FIG. 2 shows barrier 14 in its simplest form and does not show a specific means of attachment to container 10. Barrier 14 could be secured in a number of different ways, for example by fastening it to the walls of container 10, molding it in place as a part of the container 10, holding it in place using features molded into the bottle walls, or making it a self-supporting, separate structure as in the preferred embodiment, which is described below.

Figure 3:
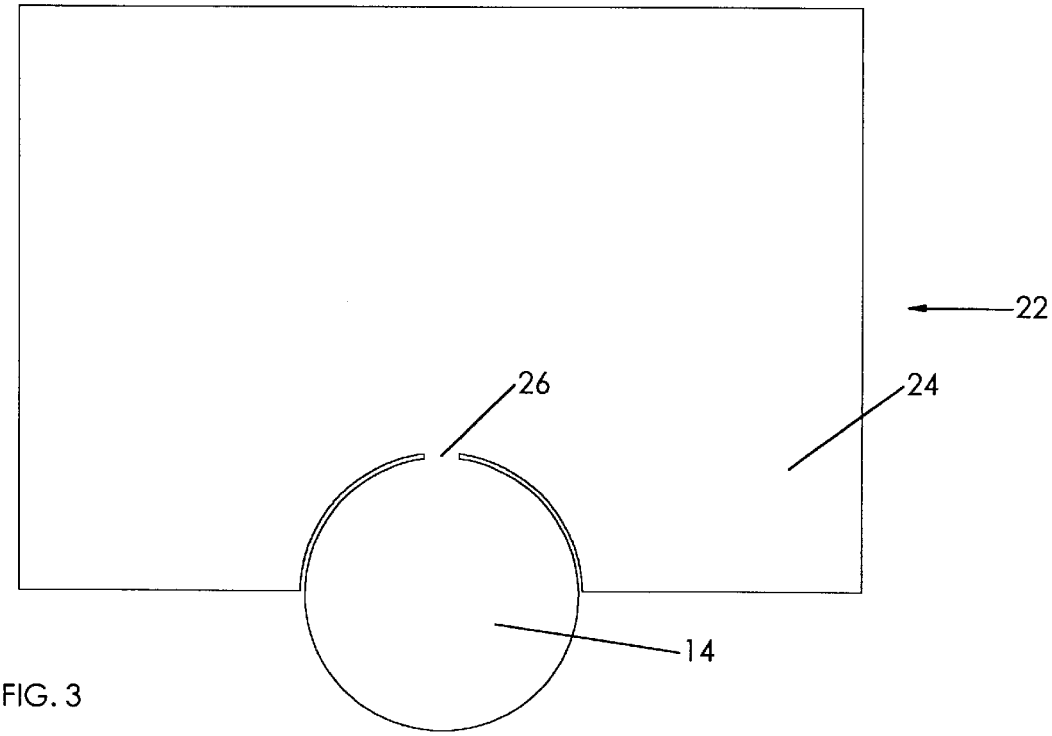
FIG. 3 is a plan view of a simplified, flattened barrier insert prior to insertion in a container.

In a simplified version of the preferred embodiment of the present invention, barrier 14 is part of a larger barrier insert 22 that is inserted into container 10. A plan view of simplified barrier insert 22 in its flattened state is shown in FIG. 3. Barrier insert 22 consists of the barrier 14, which is round and sized to be just slightly smaller than the inside diameter of container 10, and a tube 24 (FIG. 3 shows the tube 24 in its flattened state). The barrier 14 is connected to the tube by a living hinge 26 (in other words, by a piece of the plastic which is caused to bend, thereby functioning as a hinge). Barrier insert 22 is fabricated from a thin sheet of material, preferably the same plastic material from which container 10 is fabricated. For example, if container 10 were made from PETE (Polyethylene Terephthalate), then so would the barrier insert 22. By using the same material as the container 10, there are no recycling problems resulting from dissimilar materials, and the barrier insert 22 will be just as suitable for contact with the beverage as the container 10 itself Insertion of barrier insert 22 in container 10 is accomplished by first bending insert 22 at hinge 26 so that barrier 14 is perpendicular to the tube 24 portion of the insert 22. The insert 22 is then rolled-up and inserted it into container 10 through mouth 11. Once inside container 10, insert 22 will unroll itself due to its own elasticity.

Figure 4:
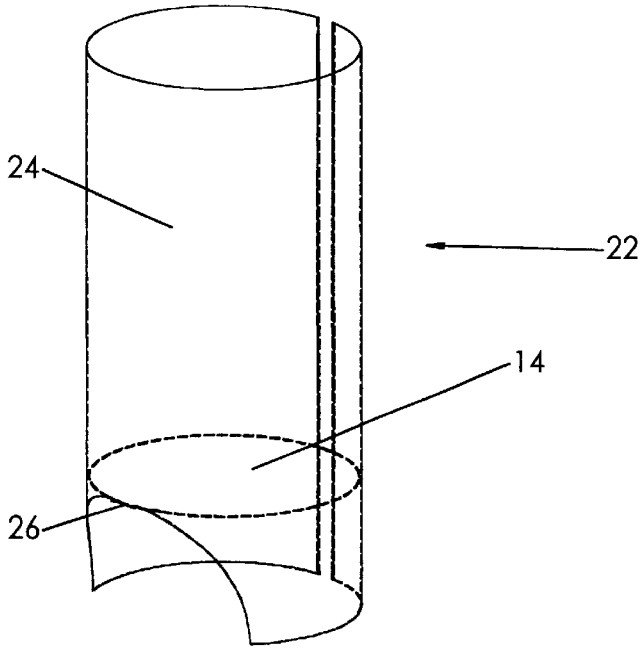
FIG. 4 is an isometric view of a simplified barrier insert as it would appear after insertion in a container (the container is not shown in FIG. 4).

FIG. 4 shows an isometric view of barrier insert 22 in its normal state, as it would appear after it is unrolled inside container 10 (for clarity, FIG. 4 does not show container 10). After unrolling, the tube 24 portion of the barrier insert 22 expands to conform to the inside diameter of container 10. Barrier 14 is bent at living hinge 26 so that it is perpendicular to the axis of container 10 and to the axis of tube 24. Barrier 14 is sized so that when tube 24 has conformed to the inside of container 10, the circumference of barrier 14 will just seat against the inside of tube 24. Thus barrier insert 22 locates barrier 14 inside container 10 as desired, in a very low-cost and simple way requiring no adhesives, welding or special molding steps. Barrier insert 22 holds barrier 14 in place securely enough to provide the desired freezing characteristics, yet barrier 14 is still flexible (or loose) enough within container 10 to allow fluid to pass around it for filling and emptying ice compartment 18.

Figure 5:
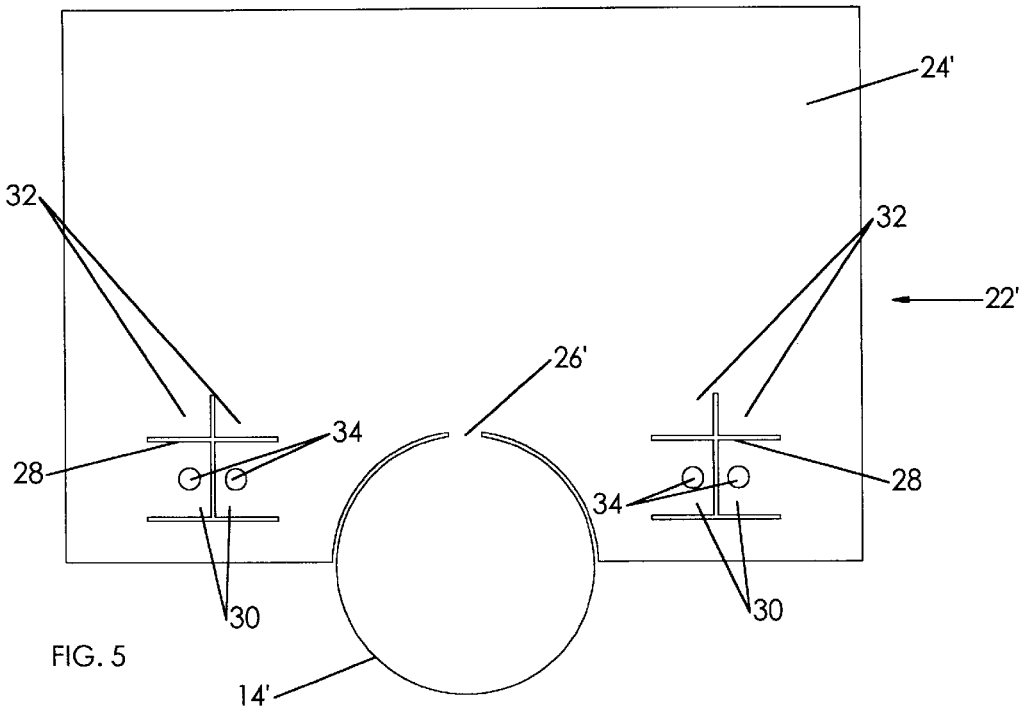
FIG. 5 is a plan view of the preferred embodiment of the barrier insert prior to forming or insertion into a container.

FIG. 5 shows a plan view of the fully-featured version of the preferred embodiment of barrier insert 22' in a flattened state. As shown FIG. 5, there are cuts in tube 24' to provide flaps that will be used both to lock barrier 14' in place and to provide a "slow-melting" feature that reduces the rate at which the ice in the ice compartment 18 melts. FIG. 5 shows cuts 28 in tube 24'. These cuts 28 define four rectangular flaps 30 and four triangular flaps 32. Rectangular flaps 30 also have holes 34 cut through them.

Figure 6:
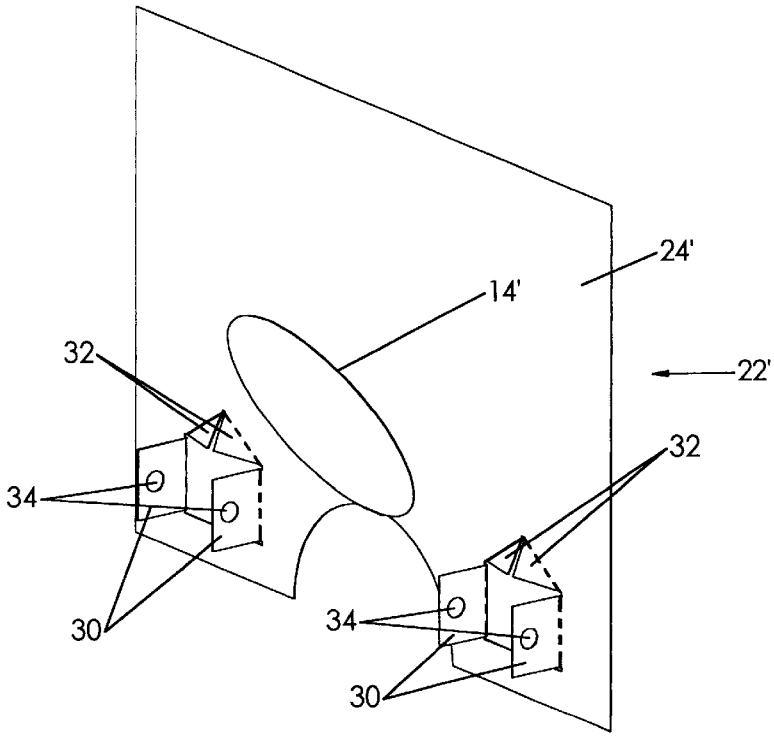
FIG. 6 is an isometric view of the preferred embodiment of the barrier insert after forming but prior to insertion in a container.

FIG. 6 shows an isometric view of barrier insert 22' again in the flattened state, but with barrier 14', flaps 30 and flaps 32 bent up. This is how barrier insert 22'would look just prior to rolling-up for insertion into container 10.

Figure 7:
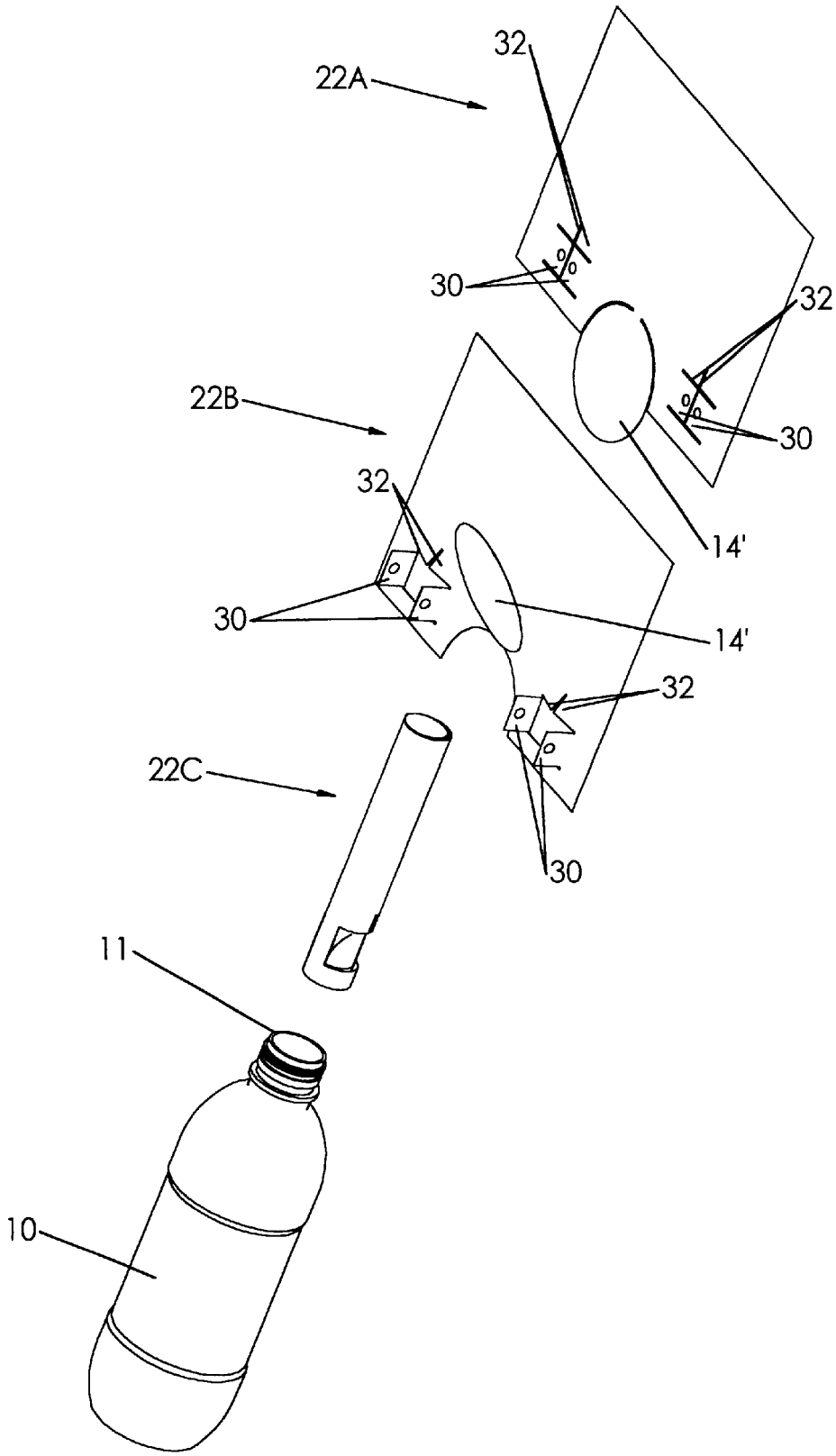
FIG. 7 shows three isometric views of the preferred embodiment of the barrier insert illustrating the sequence of insertion into a container.

FIG. 7 is an isometric view showing the sequence of forming and inserting barrier 22' into container 10. First, the flattened barrier insert 22A is formed by punching it from a sheet of plastic. During the punching operation, cuts are made in barrier insert 22A defining barrier 14' and flaps 30 and 32. Second, barrier 14' and flaps 30 and 32 are bent up so that the barrier insert looks like barrier insert 22B shown in FIG. 7. Third, the barrier insert is rolled up so that the outside diameter of the rolled-up barrier insert 22C is smaller than the inside diameter of the mouth 11 of container 10. The rolled-up barrier insert 22C is then inserted through and past the mouth 11 of container 10. Once clear of the mouth 11, the barrier insert 22C will unroll itself, expand and essentially lock itself in place inside container 10. The final step in the insertion process is not shown in FIG. 7. This final step involves pushing the barrier 14' down towards the bottom of container 10 so that the edges of barrier 14' become locked between flaps 30 and flaps 32. This locked position is illustrated in FIG. 8.

Figure 8:
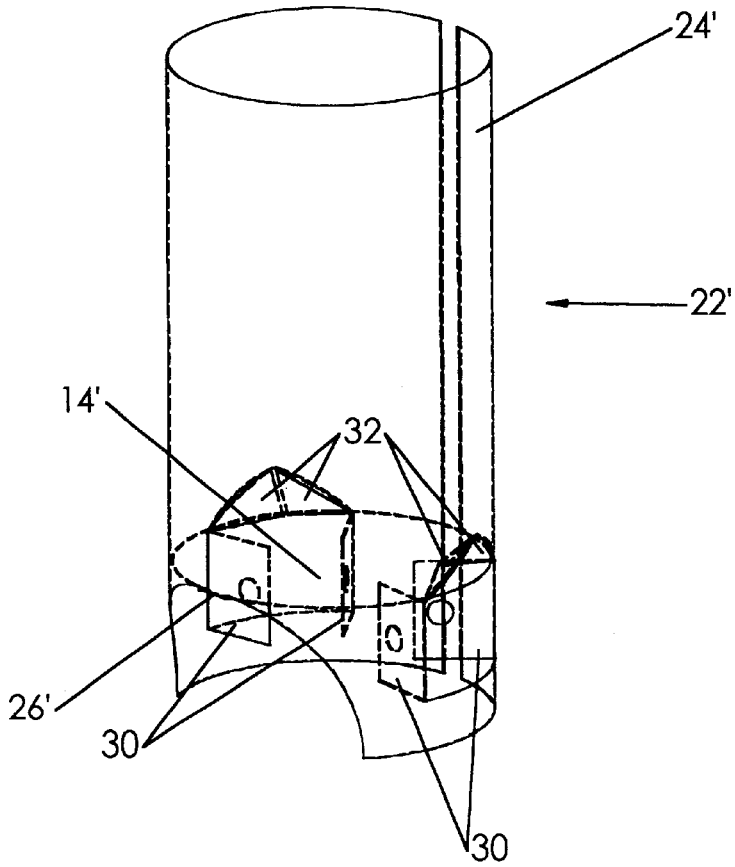
FIG. 8 is an isometric view of the preferred embodiment of the barrier insert as it would appear after insertion in a container (the container is not shown in FIG. 8).

FIG. 8 is an isometric view of preferred embodiment of the barrier insert 22' in its normal state after it has been inserted into container 10 and the barrier 14' has been locked in place (for clarity, container 10 is not shown in FIG. 8). FIG. 8 shows that once again the tube 24' portion of the insert 22' conforms to the inside diameter of the container 10. The barrier 14' is perpendicular to the axis of the container 10 and that of the tube 24'. The edge of barrier 14' is locked between flaps 30 and flaps 32, i.e., below triangular flaps 32, and above rectangular flaps 30. Locking barrier 14' in place this way, in combination with the stiffness that the container has once it is filled and sealed, insures that barrier 14' cannot be accidentally knocked out of its desired position. Once container 10 has been opened, however, the walls of container 10 have enough "give" in them that it is possible to squeeze the bottle enough to pop the barrier 14' out of position.

The triangular flaps 32 are constructed such that when barrier 14' is pushed down, barrier 14' can pass over flaps 32—these flaps simply bend out of the way. Once barrier 14' has been pushed past flaps 32, the flaps 32 will snap back into their previous position, and essentially lock barrier 14' beneath them. The rectangular flaps 30, on the other hand, cannot bend out of the way, and thus provide a stop for barrier 14', preventing it from bending any further down. So once barrier 14' has been pushed past flaps 32, it will become locked below triangular flaps 32 and above rectangular flaps 30.

The flexible nature of barrier 14' and the clearance between it and tube 24' allow the beverage 20 to pass around barrier 14' from the beverage compartment 16 into (or out of) the ice compartment 18. By increasing or decreasing this clearance, it is possible to make the flow of beverage between the two compartments less or more restricted.

Holes 34 are shown in rectangular flaps 30 (see FIG. 6). These holes 34 will help to anchor the ice in the ice compartment 18 once the ice has been frozen. By anchoring the ice in the ice compartment 18, it is possible to slow the melting rate of the ice by inverting container 10, as will be described later.

Figure 9:
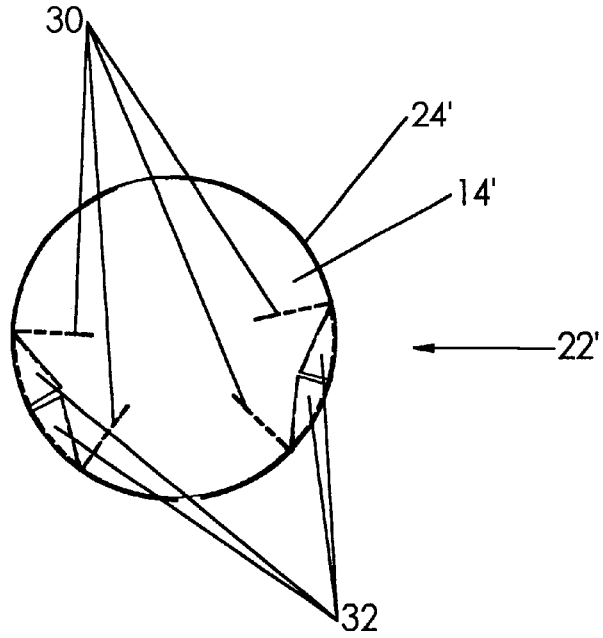
FIG. 9 is a top view of the preferred embodiment of the barrier insert as it would appear after insertion in a container (the container is not shown in FIG. 9).

FIG. 9 is a top view of barrier insert 22' in its normal state after it has been inserted into container 10 (for clarity, container 10 is not shown in FIG. 9). FIG. 9 shows rectangular flaps 30 below barrier 14' protruding inward towards the axis of tube 24'. Triangular flaps 32, which are located above the barrier 14', are also shown protruding towards the center, or axis, of tube 24'.

Filling and Freezing the Container

Barrier insert 22' would be installed in container 10 prior to container 10 being filled with a beverage 20. However, the last step in the barrier installation process—that is, pushing down barrier 14' and locking into place—may or may not be done prior to filling. In some cases, it may not be possible to fill container 10 fast enough after barrier 14' has been locked in place because the barrier 14' obstructs the flow of beverage 20 into ice compartment 18. In those cases, it will be preferable to lock barrier 14' into place after container 10 has been filled. Since locking barrier 14' into place simply involves pushing it down, this step is easily accomplished with container 10 either empty or full. After filling and locking barrier 14' into place, the cap 12 would be secured onto container 10.

Figure 10:
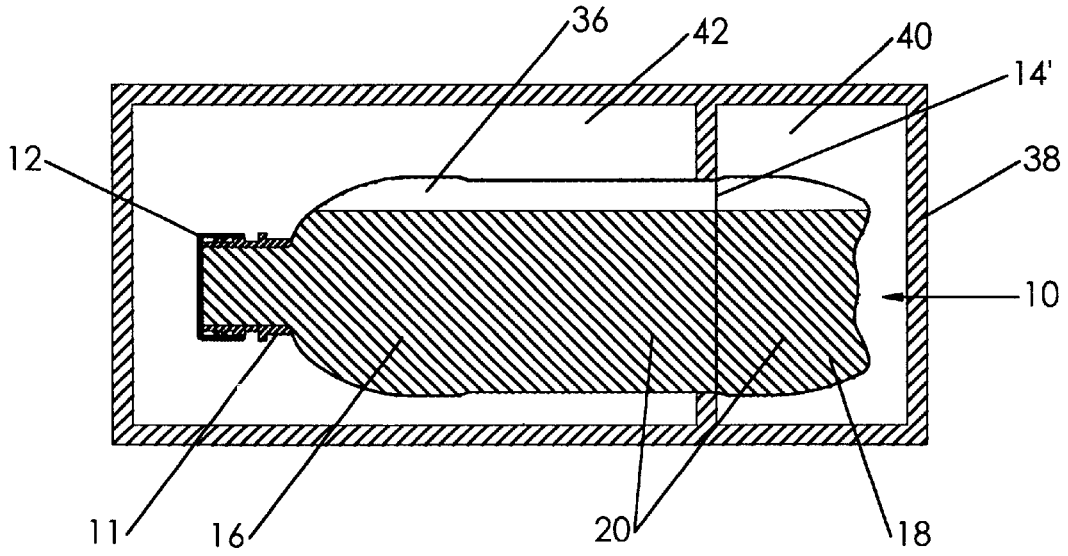
FIG. 10 is a vertical cross-section of the container laying horizontally inside a freezing enclosure.

Once container 10 has been filled and capped, it can be stored or shipped to its intended point of sale. While the beverage 20 in ice compartment 18 can be frozen at any time, it is anticipated that it would not be refrigerated or frozen until it reached its final point-of-sale destination. Thus storage and transport of the container will not require any special or expensive refrigeration equipment Freezing of the beverage 20 in the ice compartment 18 can be done with container 10 in a horizontal position (that is, laying on its side) as is shown in FIG. 10, or upright. This is to insure that there is air 36 (or other gas) in the beverage compartment 16 after freezing. If instead, all the air is frozen into the ice compartment 18 (for example if the container is frozen upside-down), the frozen container will look as if it were capped when it was completely fall, with no air at the top. Such a container, when opened, will shoot beverage out the top—an undesirable consequence.

Also shown in FIG. 10 is a freezing enclosure 38 which provides the dual-temperature environment needed to properly freeze container 10. Freezing must be done with the ice compartment 18 exposed to below-freezing temperature environment 40 while the beverage compartment 16 is exposed to above-freezing temperature environment 42. When exposed to such a dual-temperature environment, the beverage 20 in the ice compartment 18 will freeze and the beverage 20 in the beverage compartment 16 will not. It is the presence of barrier 14' that allows this to occur, as it prevents the beverage 20 in the ice compartment 18 from mixing with the beverage 20 in the beverage compartment 16. Without the barrier 14' in place, the beverage 20 will tend to either all freeze, or all stay unfrozen. As one would expect, however, if either of the two temperatures are too high or too low, either too much or too little freezing will occur. Typically, below-freezing temperatures for the ice compartment 18 in the 0 to 20° F. range and above-freezing temperatures for the beverage compartment 16 in the 34 to 40° F. range are adequate for freezing most beverages.

Container Operation After Freezing

Figure 11:
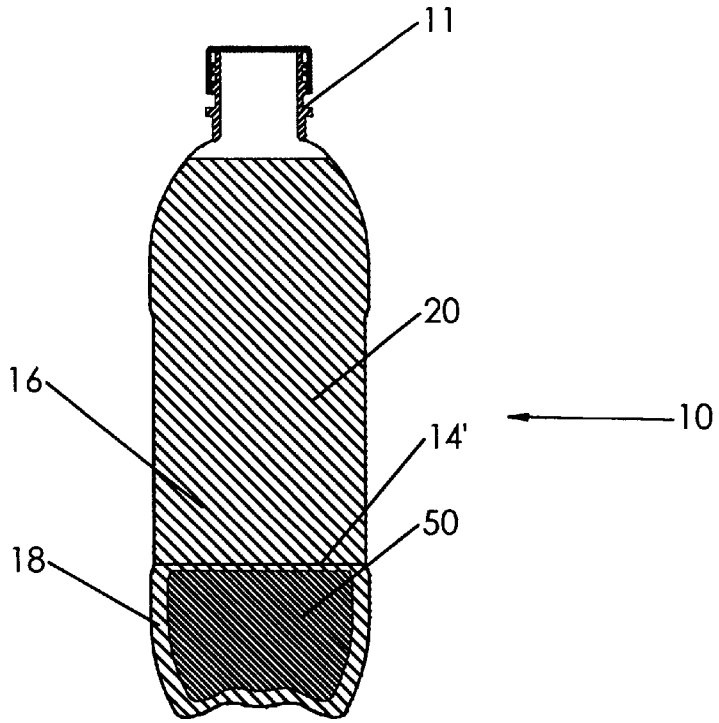
FIG. 11 is a vertical cross-section of the container in an upright position after the beverage in the ice compartment has been frozen and then allowed to thaw slightly.

Once the beverage 20 in the beverage compartment 16 has been frozen, no special steps are required to "operate" the container. One simply opens the container and drinks the beverage. If container 10 is left sitting upright as is shown in FIG. 11, frozen beverage or ice 50 in the ice compartment 18 will provide cooling to the unfrozen beverage 20. The transfer of heat from the ice 50 to the unfrozen beverage 20 will cause the ice 50 to slowly melt away from the walls of the ice compartment 18, as is shown in FIG. 11. The cooling of beverage 20 can be increased by tipping the container 10 back and forth to cause more mixing between the ice 50 and the unfrozen beverage 20.

Because the barrier 14' is locked in place by the flaps 30 and 32, the ice 50 in the ice compartment 18 is effectively locked in place, too. While there is enough "give" and leakage in and around barrier 14' to allow the beverage 20 to pass between the two compartments, it will not allow ice 50 to pass from the ice compartment 18 to the beverage compartment 16. This prevents pieces of ice from either blocking the mouth 11 of container 10 or from unexpectedly passing into the mouth of the person consuming the beverage 20.

It should be noted that since the ice 50 is locked in place by the barrier 14', if the beverage 20 is poured out of the container 10, the ice 50 will not come with it. Thus the poured-out beverage 20 would lose the cooling benefit provided by the ice 50.

Slow-Melting Feature

Figure 12:
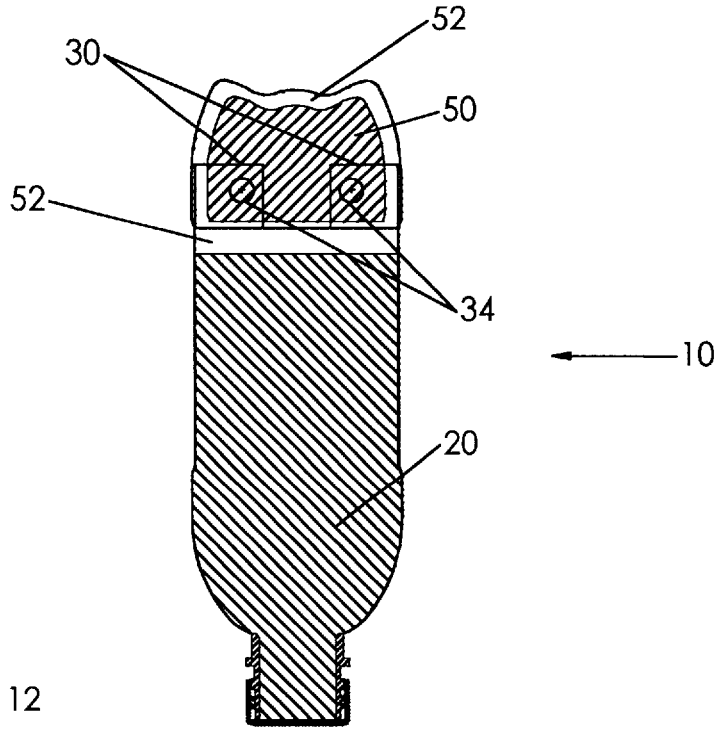
FIG. 12 is a vertical cross-section of an inverted container after the beverage in the ice compartment has been frozen and then allowed to thaw slightly.

The holes 34 in rectangular flaps 30 provide the preferred embodiment of the barrier insert 22' with an additional feature—the ability to greatly slow the rate of the ice melting when the container 10 is inverted. When beverage 20 is frozen in the ice compartment 18, it will freeze around and through the holes 34 in flaps 30. By freezing this way, the frozen beverage or ice 50 essentially anchors itself to the holes 34 and thus to the entire barrier insert 22'. With the ice anchored in place this way and container 10 inverted, as the ice 50 melts, the melted ice (i.e., beverage) will drain away from the ice 50, out of the ice compartment 18, and into the beverage compartment 16. This leaves the remaining ice suspended within the ice compartment 18, held in place by the flaps 30, surrounded by an insulating layer of air 52. FIG. 12 shows such a container 10 inverted with partially melted ice 50 suspended within the ice compartment 18. Because the ice 50 is completely surrounded by the insulating layer of air 52 rather than being submerged in beverage 20 (as it is when container 10 is held upright), the rate at which the ice 50 transfers heat with its surroundings is greatly reduced. The net result is that the ice will last roughly twice as long when the container 10 is held in an inverted orientation as when it is held upright.

For the slow melting to work properly, it is important that there be enough air in container 10 so that the melted ice can drain down out of contact with ice 50. If, on the other hand, container 10 were filled completely so there was no air inside it at all, there could be no air gap 52 between the ice 50 and the walls of container 10, and slow melting could not occur.

Beverage Considerations

Different beverages react differently when frozen. Pure water is completely unaffected by freezing. But almost all other beverages react less favorably. The tendency is for freezing to remove the water from the beverage, leaving the remaining beverage more concentrated than it was initially. The frozen portion is thus less concentrated than the beverage was initially. Likewise, freezing carbonated beverages can affect the level of carbonation. For these reasons it is important that only a relatively small portion (one third or less) of the beverage be frozen.

Alternate Embodiments

Figure 13:
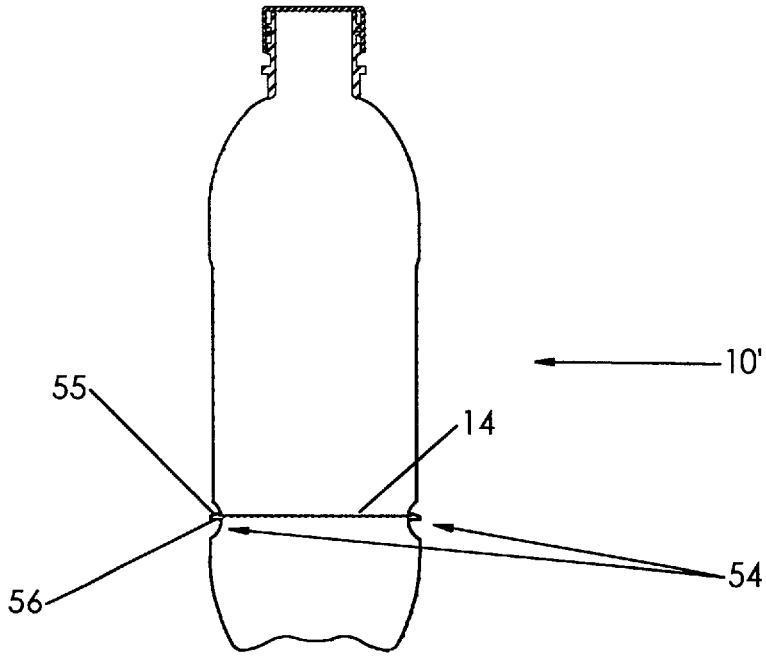
FIG. 13 is a vertical cross-section of an alternate embodiment of the container utilizing contours molded into the bottle wall to hold the barrier in place.

FIG. 13 illustrates an alternate beverage container 10' wherein contours 54 are molded into the sides of the container to hold barrier 14 in position. This alternate embodiment greatly reduces the size (and corresponding material cost) of barrier 14, as barrier 14 (in this embodiment) is simply a round plastic disk. This embodiment would however require a specially designed beverage container 10'. As shown in FIG. 13, barrier 14 would be inserted into container 10' such that it is trapped between the upper face 55 of feature 54 and lower face 56 of feature 54.

Figure 14:
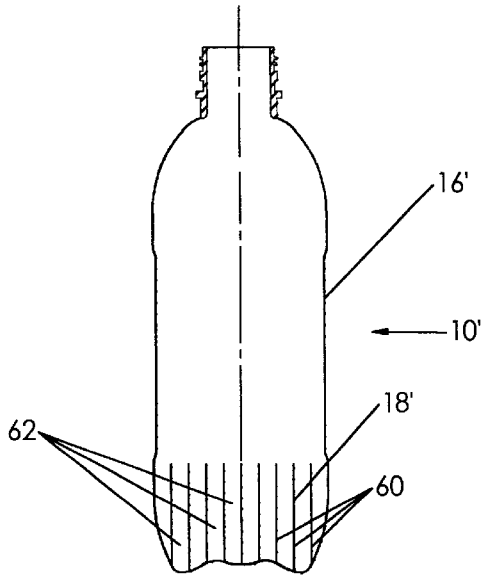
FIG. 14 is a vertical cross-section of an alternate embodiment of the container using walls to create the ice compartment.

There are means other than a barrier 14 between compartments that can be used to achieve the desired freezing effect. For example, by placing walls 60 at the bottom of container 10' as shown in FIG. 14, it is possible to create a beverage compartment 16' and an ice compartment 18' which are not actually physically separated. Instead, the two compartments are differentiated by their ability to sustain convection currents. Beverage compartment 16' is large enough so that convection currents can exist within it. Ice compartment 18', on the other hand, is divided into an array of cavities 62 by walls 60. The size of the cavities 62 and/or the walls 60 disrupt convection currents in cavities 62 and ice compartment 18'. When placed in a dual-temperature environment where ice compartment 18' is exposed to below-freezing temperatures and beverage compartment 16' is exposed to above-freezing temperatures, convection currents will keep the beverage 20 inside the beverage compartment 16' at a fairly uniform temperature above freezing. The beverage 20 inside the ice compartment 18' (and inside cavities 62) will tend not to mix as readily with the beverage 20 in the beverage compartment 16' and will thus become colder and freeze.

Walls 60 can be created within a container 10' for example by molding them in place (as an integral part of container 10') or by inserting a separate structure having such walls (a plastic extrusion, for example) into the container 10' after it has been fabricated.

Figure 15:
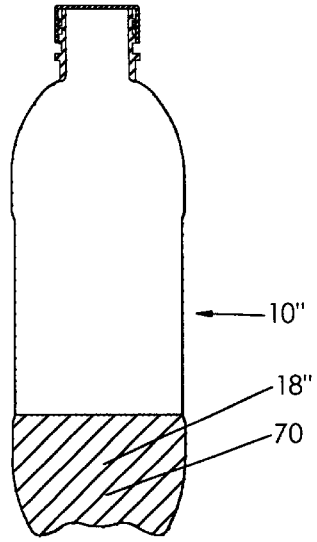
FIG. 15 is a vertical cross-section of an alternate embodiment of the container using a porous object to create the ice compartment.

It is also possible to create an ice compartment 18" in a container 10" by inserting or creating a porous object 70 in the region of the container 10" where it is desired to form ice 50. The porous object 70 would allow beverage 20 to flow into or out of the ice compartment 18", while also serving to minimize the convection currents and the resulting mixing between the ice compartment 18" and the beverage compartment 16" caused by temperature differences between the two compartments. Such a configuration is illustrated in FIG. 15. The porous object 70 could be, for example, a plastic mesh or a sponge-like material that would allow material to flow though it, but would inhibit temperature-driven convection currents or mixing.

Accessories

Figure 16:
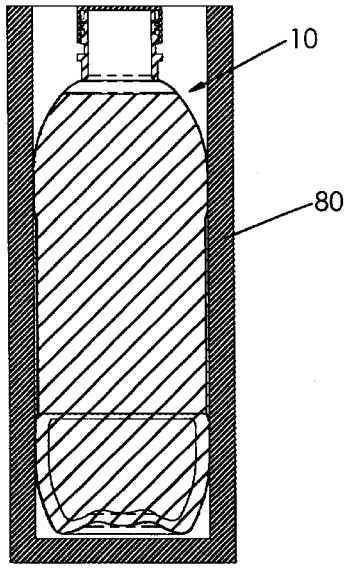
FIG. 16 is a vertical cross-section of the present invention having an insulated sleeve for the purpose of minimizing heat transfer with the surroundings.
Figure 17:
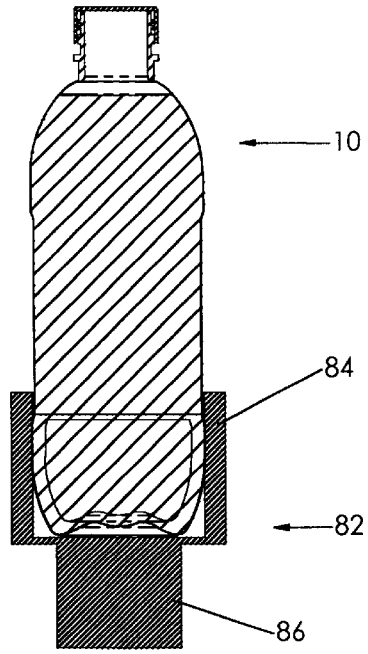
FIG. 17 is a vertical cross-section of the present invention having an insulated sleeve that is configured for insertion in an automobile cup-holder.

FIG. 16 and 17 illustrate two insulating sleeves that can be used with beverage container 10 to improve the container's ability to stay cold. The insulated sleeve 80 shown in FIG. 16 simply insulates the container 10 from the surrounding ambient environment, reducing the rate of heat transfer with the surrounding environment, and thereby container 10 to stay cold longer. Insulated sleeve 80 could be made from virtually any suitable insulating material, such as insulated fabric or foam rubber.

FIG. 17 shows an insulated sleeve and cup-holder adapter 82 for keeping container 10 cold longer, while also holding container 10 in an automobile cup-holder that is otherwise to small to hold container 10. The upper portion 84 of adapter 82 is insulated and sized to fit snugly around container 10. The lower portion 86 of adapter 82 has a smaller diameter than container 10 and is sized to fit smaller-sized automobile cup-holders. Thus the upper portion 84 helps keep container 10 cold longer while the lower portion 86 allows people to utilize their automobile cup-holders that would otherwise be too small for container 10.

What I claim is:

1. A fluid container comprising:

a. a container for containing a fluid;

b. a first compartment for containing a portion of said fluid;

c. a second compartment for containing a portion of said fluid;

d. said second compartment being defined by one or more structures within said container which allow said fluid to pass from said first compartment into said second compartment, and, when filled with said fluid, said structure or structures inhibiting temperature-induced mixing of said portion of fluid in said first compartment with said portion of fluid in said second compartment, whereby said portion of said fluid in said first compartments can be frozen without freezing said portion of said fluid in said second compartment.

2. The container of claim 1 wherein said container has an opening adjacent to said second compartment and said second compartment is located between said first compartment and said opening, whereby frozen fluid in said first compartment will not obstruct the flow of fluid through said opening.

3. The container of claim 1 wherein said the volume of said first compartment is one-half or less the volume of said second compartment.

4. The container of claim 1 wherein said structure or structures are made from plastic.

5. The container of claim 4 wherein said plastic is Polyethylene Terephthalate.

6. The container of claim 1 wherein said structure or structures is a barrier.

7. The container of claim 6 wherein said barrier is part of a larger structure which positions said barrier within said container.

8. The container of claim 7 further comprising at least one feature in said larger structure whereby said barrier is held in a fixed position within said container by at least one said feature.

9. The container of claim 8 having at least two of said features, at least one of said features being located on a first side of said barrier and at least one of said features being located on a second side of said barrier whereby said barrier is held in a fixed position between said features.

10. The container of claim 9 wherein said features are flaps.

11. The container of claim 7 further comprising a portion of said barrier or of said larger structure located within said first compartment and positioned to be frozen into said frozen fluid whereby said frozen fluid is held in a fixed position relative to said container by said portions when said frozen fluid melts.

12. The container of claim 6 wherein said barrier is held in place by contours molded into the walls of said container.

13. The container of claim 1 wherein said structure or structures is one or more walls which inhibit temperature-induced mixing of said fluid in said first compartment with said fluid in said second compartment.

14. The container of claim 1 wherein said structure or structures is a porous object which inhibit temperature-induced mixing of said fluid in said first compartment with said fluid in said second compartment.

15. The container of claim 1 further comprising an insulating sleeve surrounding all or some portion of said container whereby the rate of heat transfer between said container and its surroundings is reduced.

16. The container of claim 15 wherein said insulating sleeve includes a reduced diameter portion whereby said container can be fit into an automobile cup-holder that would otherwise be too small to hold said container without said sleeve.

17. The container of claim 1 further comprising an ice anchor located within said first compartment, whereby frozen fluid within said first compartment will be held in place by said ice anchor and will stay relatively fixed with respect to said container while said froze melts.

18. A method for cooling a fluid including:

a. A fluid container comprising:

i) a fluid contained within said container;

ii) a first compartment containing a portion of said fluid;

iii) a second compartment containing a portion of said fluid;

iv) said second compartment being defined by one or more structures within said container which allow said fluid to pass from said first compartment into said second compartment, and said structure or structures inhibiting temperature-induced mixing of said portion of fluid in said first compartment with said portion of fluid in said second compartment;

b. placing said container in a dual-temperature environment in which said first compartment is exposed to temperatures at or below the liquid-solid phase change temperature of said fluid while said second compartment is simultaneously exposed to temperatures at or above the liquid-solid phase change temperature of said fluid, whereby said fluid in said first compartment is caused to freeze and said fluid in said second compartment is not caused to freeze;

c. removing said container from said dual-temperature environment, whereby said fluid in said second compartment is cooled by the presence of frozen fluid in said first compartment.

19. A method for cooling a fluid including:

a. A fluid container comprising:

i) a fluid contained within said container;

ii) a first compartment containing a portion of said fluid;

iii) a second compartment containing a portion of said fluid;

iv) said second compartment being defined by one or more structures within said container which allow said fluid to pass from said first compartment into said second compartment, and said structure or structures inhibiting temperature-induced mixing of said portion of fluid in said first compartment with said portion of fluid in said second compartment;

v) an ice anchor located within said first compartment, whereby frozen fluid within said first compartment will be held by said ice anchor and will stay relatively fixed with respect to said container while said frozen fluid melts;

b. placing said container in a dual-temperature environment in which said first compartment is exposed to temperatures at or below the liquid-solid phase change temperature of said fluid while said second compartment is simultaneously exposed to temperatures at or above the liquid-solid phase change temperature of said fluid, whereby said fluid in said first compartment is caused to freeze and said fluid in said second compartment is not caused to freeze;

c. removing said container from said dual-temperature environment;

d. orienting said container so that said first compartment is located above said second compartment, whereby the portion of frozen fluid in said first compartment that is in contact with the walls of said refrigerant compartment melts and flows into said air gap, thereby leaving the remaining frozen fluid suspended by said ice anchor within said first compartment, said remaining frozen fluid being surrounded by a layer of air which thermally insulates said remaining frozen fluid and thereby reduces the rate of melting of said remaining frozen fluid.

20. A container insert consisting of:

a. a thin sheet of material;

b. a barrier portion cut into said sheet, said barrier portion being shaped to match the internal cross-section of a container;

c. at least one feature cut and/or formed in said sheet, whereby said insert can be inserted into said container and said barrier can be moved into a position where it is held in a fixed position by at least one said feature.

* * * * *